US005337060A

United States Patent [19]

Harada

[11] Patent Number: 5,337,060

[45] Date of Patent: Aug. 9, 1994

[54] MICRO-STRIP ANTENNA

[75] Inventor: Takuji Harada, Kanagawa, Japan

[73] Assignee: Harada Kogyo Kabushiki Kaisha, Tokyo, Japan

[21] Appl. No.: 910,832

[22] Filed: Jul. 6, 1992

[51] Int. Cl.[5] ..... H01Q 1/38

[52] U.S. Cl. ..... 343/700 MS; 343/846

[58] Field of Search ..... 343/700 MS, 846; H01Q 1/38

[56] References Cited

U.S. PATENT DOCUMENTS 4,792,810 12/1988 Fukuzawa et al. ..... 343/700 MS
5,099,249 3/1992 Seavey ..... 343/700 MS
5,173,711 12/1992 Takeuchi et al. ..... 343/700 MS

*Primary Examiner*—Donald Hajec
*Assistant Examiner*—Tan Ho
*Attorney, Agent, or Firm*—Koda and Androlia

[57] ABSTRACT

In a micro-strip antenna comprising a radiating conductor and a grounding conductor which are installed on either side of a dielectric, a plate-form conductor is attached to the radiating conductor at a position which is roughly at point where an extension line extended from a line, that connects the center of gravity of the radiating conductor and a feeding point, intersects an edge of the radiating conductor. The plate-form conductor is attached also at a position which is rotated 90 degrees about the center of gravity from the above-described position. In addition, a portion of the plate-form conductor is set to project from the edge of the radiating conductor. In this way, the center frequency of the micro-strip antenna can easily be corrected during the manufacturing process of the micro-strip antenna.

6 Claims, 4 Drawing Sheets

MICRO-STRIP ANTENNA

BACKGROUND OF THE INVENTION

1. Field of the Invention

The present invention relates to a micro-strip antenna which can be used to receive satellite broadcasts, etc.

2. Prior Art

The conventional antenna shown in FIG. 5 is known as a micro-strip antenna. In this antenna, a dielectric 20 is installed on a grounding conductor 10, and a radiating conductor 30 such as copper foil, etc. is installed on the dielectric 20. Ordinarily, a substrate having copper foils on both sides of a dielectric is used as a micro-strip antenna. More specifically, a dielectric is sandwiched between two pieces of copper foils, and a copper foil on one side of the dielectric is used as the grounding conductor 10, and a copper foil on the other side is used as the radiating conductor 30 after being etched into a prescribed shape.

The center frequency of the micro-strip antenna varies depending upon the length of one side of the radiation conductor 30, the thickness of the dielectric 20, the dielectric constant of the dielectric 20, and other factors.

Normally, the reception frequency band width of a micro-strip antenna is 1 to 2% of the center frequency of the band to be received, and if errors occur somewhere in the material management and during the manufacturing process, etc. of the antenna, the center frequency may shift, causing the transmission frequency of satellite broadcasts not to fall within the reception band of the micro-strip antenna. For example, if a substrate having a dielectric constant of 2.6 is used as the dielectric so that the antenna's center frequency is 575 GHz and the dimensional precision is set at 200 microns, then the center frequency can shift as much as 10 MHz. If the center frequency of the reception frequency band is 1,575 MHz, the band width of such a frequency is in the range of 15.75 to 31.5 MHz, and if the dimensional precision of the antenna drops and other conditions affect the antenna, the center frequency of the micro-strip antenna would further shift so that the transmission frequency of satellite broadcasts never fall within the reception frequency band of the antenna.

Thus, conventionally, it is difficult to manufacture micro-strip antennas with a uniform center frequency.

SUMMARY OF THE INVENTION

The object of the present invention is to provide a micro-strip antenna which can easily allow the correction of the center frequency of the antenna during the manufacturing process.

According to the present invention, in a micro-strip antenna in which a radiating conductor and a grounding conductor are installed on both sides of a dielectric, a plate-form conductor is provided on the radiating conductor at a position where a line extended from a line, which connects the center of gravity of the radiating conductor and a feeding point, intersects the edge of the radiating conductor. The plate-form conductor can, alternatively, be provided at 90 degrees rotated about the center of gravity of the conductor. In addition, the plate-form conductor can be set so that a portion of it projects from the circumferential edge of the radiating conductor.

BRIEF DESCRIPTION OF THE DRAWINGS

FIG. 2(*b*) is a front view thereof;

DETAILED DESCRIPTION OF THE INVENTION

Figure 1:
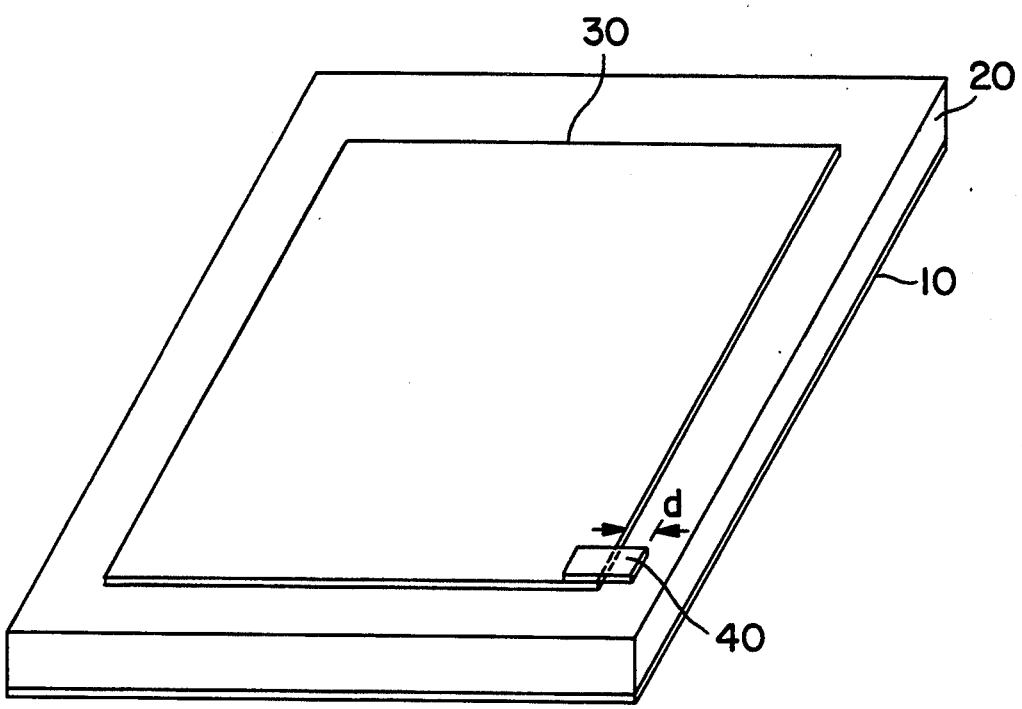
FIG. 1 is a perspective view of one embodiment of the present invention.

FIG. 1 is a perspective view showing one embodiment of the present invention.

in this embodiment, a dielectric 20 is installed on a grounding conductor 10, and a radiating conductor 30 is provided on the dielectric 20. In addition, a copper foil 40 is attached to the radiating conductor 30 via an adhesive agent, etc. The sizes of the grounding conductor 10 and the dielectric 20 can vary depending upon the frequency level of the signals to be received. In this embodiment, it is assumed that 1.5 GHz signals are received. Thus, in view of the signals, the conductor 10 and the dielectric 20 are 7 cm square shape, respectively. The size of the radiating conductor 30 can also vary depending upon the frequency level of the signals to be received. One edge of the square radiating conductor 30 is approximately ¼ the reception wavelength; accordingly, in view of this wavelength, the radiating conductor 30 in this embodiment is approximately 5 cm square.

The copper foil 40, as described above, is attached to the radiating conductor 30 via an adhesive agent, etc., and as seen (from above) in FIG. 1, a part of the copper foil 40 projects from the radiating conductor 30 for a predetermined length (in other words, the copper foil 40 projects beyond the edge line of the conductor 30). The center frequency of the micro-strip antenna which is thus structured can be adjusted by selecting an appropriate projecting length d of the copper foil 40 when the copper foil 40 is attached to the radiating conductor 30.

The copper foil 40 is an example of the plate-form conductor used for the antenna thus constructed, and the plate-form conductor is positionally fixed at a point or near such a point where an extended line, which is extended from a line that connects the center of gravity of the radiating conductor and a feeding point, intersects the edge of the radiating conductor 30. The plate-form conductor 40 can also be positionally fixed at points or near such points where a line, that perpendicularly crosses the above-described extended line on the center of gravity of the conductor, intersects the edge of the radiation conductor. A part of the plate-form conductor or the copper foil 40, in this case too, projects from the circumferential edge of the radiating conductor 30.

Figure 2A:
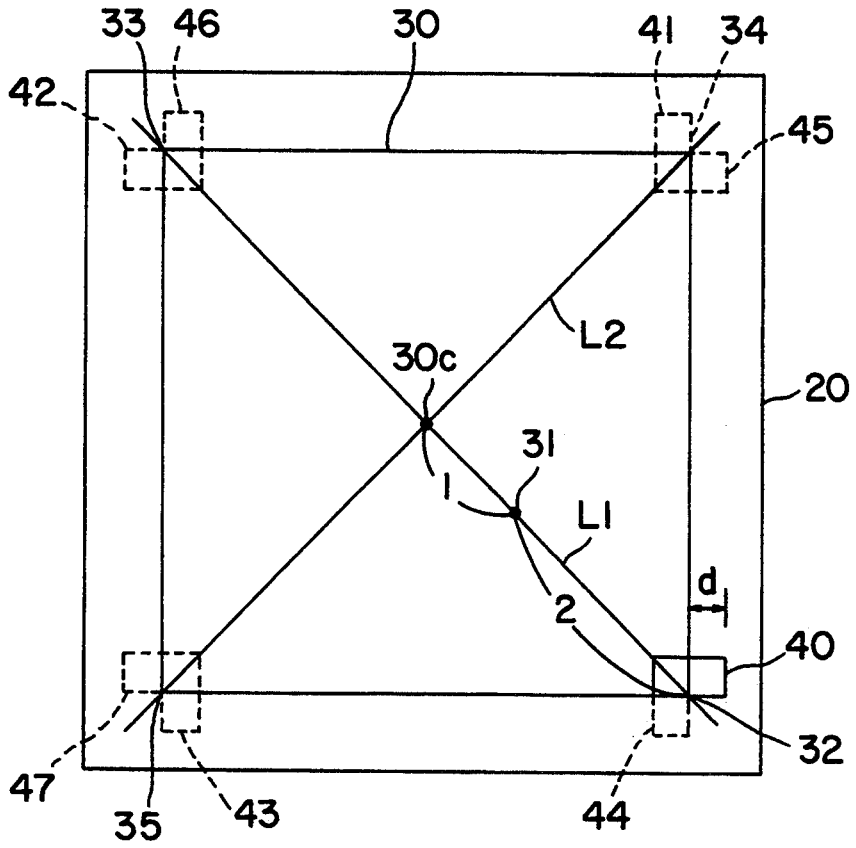
FIG. 2(*a*) is a top view showing a position where a copper foil is provided in the embodiment.
Figure 2B:
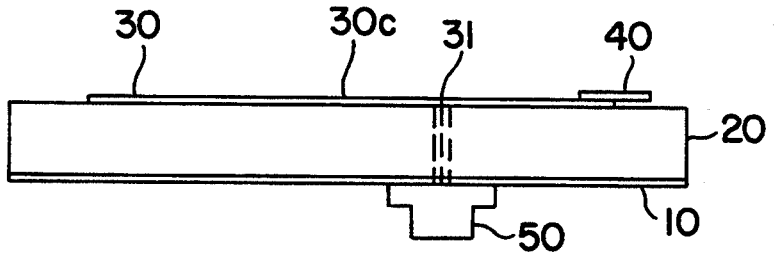

FIGS. 2(*a*) and 2(*b*) show the positions where the copper foil 40 is attached to the conductor 30 in the embodiment, in which FIG. 2(*a*) is the top view and FIG. 2(*b*) is the front view.

The radiating conductor 30 is positioned approximately at the center of the dielectric 20. A connector 50 is installed directly beneath a dividing point (feeding point) 31. The dividing (or feeding) point 31 is located on a straight line, which is between the center of gravity 30c of the radiating conductor 30 and the corner 32 of the radiating conductor 30. In other words, the dividing (or feeding) point 31 is at a distance 1 from the center of gravity 30c and a distance 2 from the corner 32. The core wire of the connector 50 is connected to the radiating conductor 30, and the outer-covering conductor of the connector 50 is connected to the grounding conductor 10.

Furthermore, the copper foil 40 is attached to the radiating conductor 30 and is positionally fixed at a point where a line L1, which is extended from a line that connects the center of gravity 30c of the radiating conductor 30 and the feeding point 31, intersects the edge of the radiating conductor. In FIG. 2(*a*), the copper foil 40 projects in a lateral direction. A proper amount of projection of the copper foil 40 is obtained by adjusting the projecting amount d until the center frequency of the antenna reaches a desired value. This can be done by connecting the micro strip antenna structured as described above to a network analyzer and observing the standing wave ratio (SWR).

If the center frequency of the signals to be received is other than 1.5 GHz, the size of the grounding conductor 10, the size of the dielectric 20, the size of the radiating conductor 30 and/or the dielectric constant of the dielectric 20 are changed in accordance with the reception frequency band before the copper foil 40 is attached to the radiating conductor 30.

The copper foil 40 in the above embodiment has conducting surfaces on the both sides (thus being a "two-sided conductor"). However, instead of such a copper foil 40, a one-sided conductor can be used that has an insulating surface which faces the radiating conductor 30 and a conducting surface which faces away from the radiating conductor 30. If the one-sided conductor is used such that the insulating surface is positioned between the one-sided conductor and the radiating conductor 30, there is no direct contact between the conducting surface of the one-sided conductor and the radiating conductor 30; and as a result, a capacitance is formed between the conducting surface and the radiating conductor 30. Such a capacitance, however, can be ignored from an electrical standpoint, because the frequency of the signals to be received is extremely high. A capacitance, though being different in magnitude, can also be formed between the conductor 30 and the foil 40 if an adhesive agent is used for fixing the copper foil 40 to the radiating conductor 30.

If the copper foil 40 is adjusted on the radiating conductor 30 for obtaining an appropriate projection length while the foil is in contact with the conductor 30 with an adhesive agent in between (thus forming a "tight contact type"), the center frequency shifts by approximately 10 MHz as the projecting amount d of the copper foil 40 from the radiating conductor 30 changes 0.1 mm. On the other hand, if a one-sided conductor, which is a flexible substrate with a thickness of 0.2 mm, is used instead of the copper foil 40 and adjusted on the radiating conductor 30 for obtaining an appropriate projection length while the substrate is in contact with the conductor 30 with an adhesive agent in between, the center frequency shifts only by 1 MHz as the projecting amount d changes 0.1 mm. Thus, in the tight contact type, a shift of approximately 100 MHz of the center frequency is possible at maximum; however, when a one-sided conductor is used, only a maximum shift of about 10 MHz is available. It can be seen from the above that a one-sided conductor affects the shift of the center frequency less than a tight-contact type conductor does.

More specifically, before the copper foil 40 or one-sided conductor is attached, the center frequency of the micro-strip antenna is set slightly higher than the desired value. In the case of the tight contact type, however, a large amount of frequency shift is obtained by attaching the tight contact type conductor; accordingly, the frequency setting, before attaching the copper foil 40 to the conductor 30, can be done roughly, though a slight difference in the amount of projection of the copper foil 40 can cause a large center frequency shift. On the other hand, in cases where a one-sided conductor is used, a large amount of frequency shift is not obtainable (by attaching the conductor); accordingly, the setting of the center frequency of the micro-strip antenna prior to attaching the one-sided conductor to the radiating conductor must be done in a relatively accurate manner. Although the amount of projection of the one-sided conductor is changed slightly, only a little shift can be seen in the center frequency; accordingly, the adjustment of the amount of projection of the one-sided conductor can be done relatively roughly.

As described above, the position of the copper foil 40 may be at approximately the intersection 32 where an extension line L1 extended from a line, which connects the center of gravity 30c of the radiating conductor 30 and the feeding point 31, intersects the edge of the radiating conductor 30. The position of the copper foil 40 may, alternatively, be at position 33, which is the corner 32 rotated 180 degrees. Furthermore, the position of the copper foil 40 may also be either at positions 34 and 35, where a line L2, which crosses the extension line L1 perpendicularly at the center of gravity 30c, intersects the two edges of the radiating conductor 30. In this case, the copper foil 40 may be attached within a ±10 degree range around each of the positions 32, 33, 34 and 35 measured from the center of gravity 30c. In other words, instead of the position referred to by reference numeral 40 in FIG. 2(*a*), the position of the copper foil 40 may be at any one of the positions 41, 42 and 43, which are indicated by broken lines, or at any one of the positions 44, 45, 46 and 47 which are also indicated by broken lines. In this case, the positions 40 through 43 and positions 44 through 47 are determined in accordance with the circular-polarized waves which are either right-polarized or left-polarized.

In the embodiment described above, an adhesive agent is used when the copper foil 40 is attached to the radiating conductor 30. However, other mounting means can be used for attaching the copper foil 40 to the radiating conductor 30.

Figure 3:
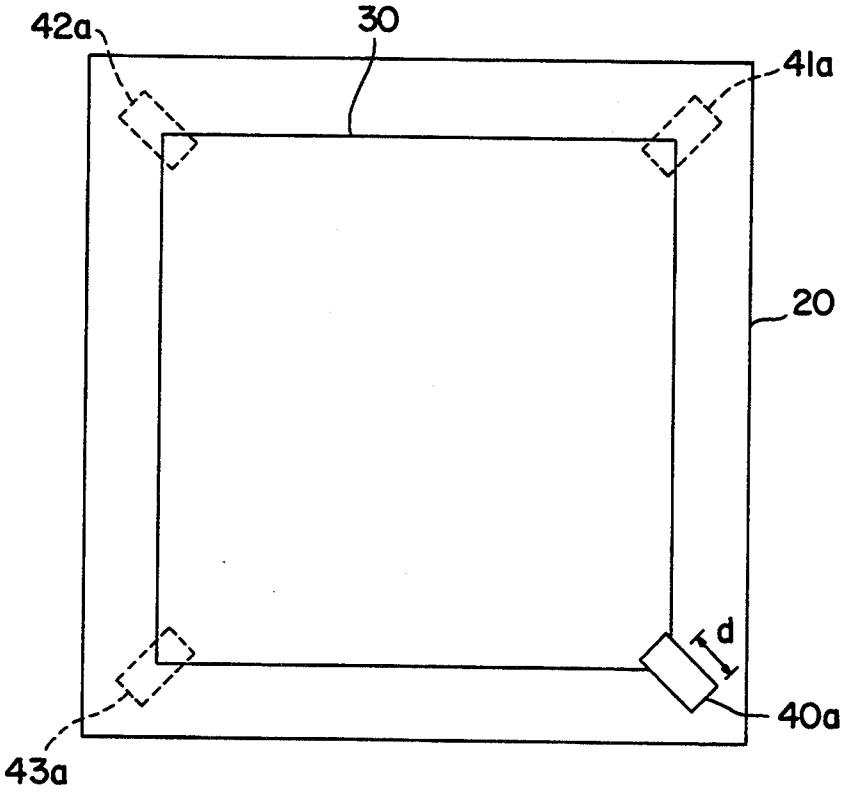
FIG. 3 is an explanatory diagram which illustrates another embodiment of the present invention.

FIG. 3 is an explanatory diagram of another embodiment of the present invention. In this embodiment, a copper foil 40a, which is similar to the copper foil 40, is attached to the radiating conductor 30 instead of the copper foil 40. The copper foil 40a is oriented in the diagonal direction of the radiating conductor 30. In addition, instead of attaching the copper foil 40a, a copper foil can be attached at any one of the positions 41a, 42a and 43a as shown by broken lines in FIG. 3.

Figure 4:
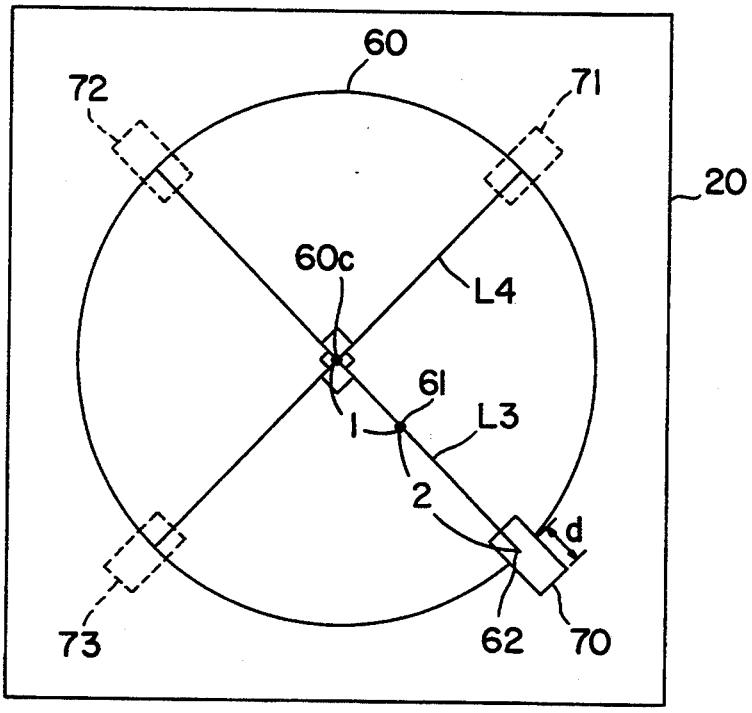
FIG. 4 is an explanatory diagram which illustrates still another embodiment of the present invention.
Figure 5:
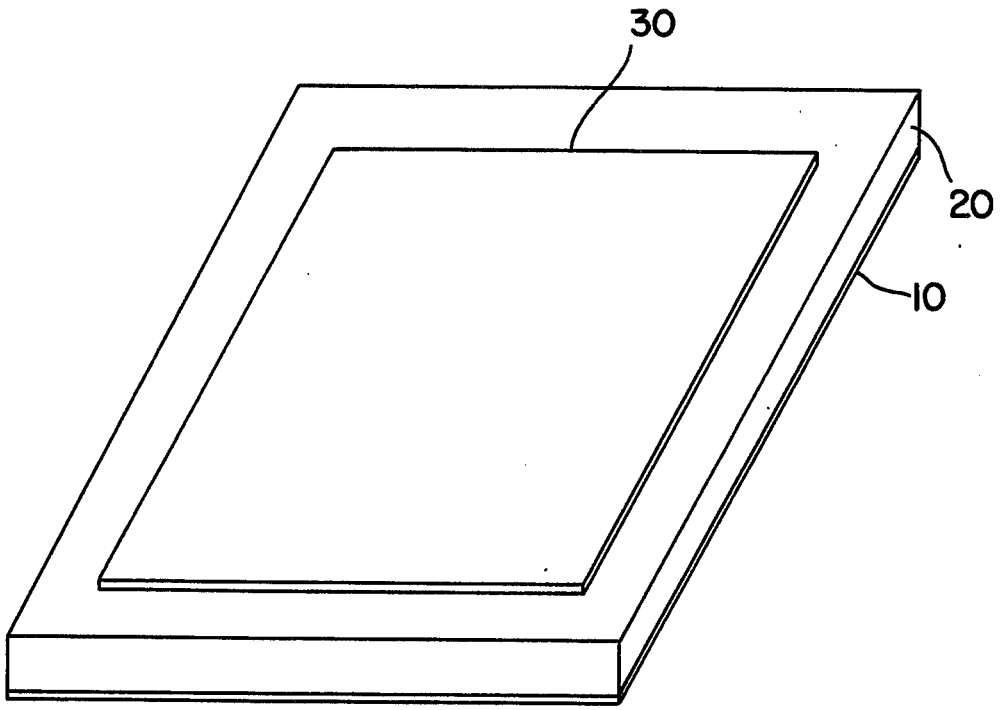
FIG. 5 PRIOR ART
FIG. 5 is a perspective view of one example of a conventional micro-strip antenna.

FIG. 4 is an explanatory diagram of still another embodiment of the present invention.

In this embodiment, a circular radiating conductor 60 is provided on the dielectric 20, and a copper foil 70, which is similar to the copper foil 40, is installed at one edge 62 of the radiating conductor 60. This copper foil 70 is installed at a position where an extension line L3, which extends from a line that connects the center of gravity 60c of the radiating conductor 60 and a position (feeding point) 61 where the core wire of a connector (not shown) is connected, intersects the edge of the radiating conductor 60. The position 61 where the core wire of the connector is connected is at a distance 1 from the center of gravity 60c and at a distance 2 from the edge of the radiation conductor.

The center frequency of the micro-strip antenna in the embodiment shown in FIG. 4 is adjusted merely by adjusting the amount of the copper foil 70 projecting from the radiating conductor 60. In the embodiment shown in FIG. 4, a copper foil that is an equivalent to the copper foil 70 is set at any one of the positions 71, 72 and 73 as indicated by broken lines instead of using the copper foil 70. In this case, the positions 71, 72 and 73 are where the copper foil 70 is rotated every 90-degree about the center of gravity 60c from the position where the copper foil 70 is provided. In other words, the copper foil 70 may be attached at either one of the positions 62 and 72, which are approximately at points where the extension line L3, that extends from a line which connects the center of gravity 60c of the radiating conductor 60 and the feeding point 61, intersects the edges of the radiating conductor 60. The foil 70 may also be attached at either one of the positions 71 and 73, which are roughly at points where a line L4, which is perpendicular to the extension line L3 at the center of gravity 60c, intersects the edges of the radiating conductor 60.

A one-sided conductor or some other type of plate-form conductor may be attached at any one of the positions 40a through 43a as shown in FIG. 3 or at any one of the positions 70 through 73 as shown in FIG. 4. In the embodiments described above, all of the copper foils 40, 40a and 70 are rectangular. However, these copper foils 40, 40a and 70 can be other than rectangular in shape. Furthermore, the plate-form conductor used in the present invention includes a thin-film conductor other than copper foils or conductors with a thickness of approximately 0.2 mm to 1 mm.

According to the present invention, the center frequency of a micro-strip antenna can easily be adjusted during the manufacturing stage of the micro-strip antenna.

I claim:

1. A micro-strip antenna in which a radiating conductor and a grounding conductor are provided on either side of a dielectric, wherein a plate-form conductor is attached to said radiating conductor approximately at a position where an extension line, that is extended from a line which connects a center of gravity of said radiating conductor and a feeding point, intersects an edge of said radiating conductor, and a portion of said plate-form conductor projects outwardly from said edge of said radiating conductor.

2. A micro-strip antenna according to claim 1, wherein said plate-form conductor is a one-sided conductor in which one surface facing said radiating conductor is an insulator and another surface facing away from said radiating conductor is a conductor.

3. A micro-strip antenna according to claim 1, wherein said plate-form conductor is a two-sided conductor in which both sides are conductors.

4. A micro-strip antenna in which a radiating conductor and a grounding conductor are provided on either side of a dielectric, wherein a plate-form conductor is attached to said radiating conductor approximately at a point where a line which perpendicularly crosses an extension line that connects a center of gravity of said radiating conductor and a feed point intersects an edge of said radiating conductor, and a portion of said plate-form conductor projects outwardly from said edge of said radiating conductor.

5. A micro-strip antenna according to claim 4, wherein said plate-form conductor is a one-sided conductor in which one surface facing said radiating conductor is an insulator and another surface facing away from said radiating conductor is a conductor.

6. A micro-strip antenna according to claim 4, wherein said plate-form conductor is a two-sided conductor which both sides are conductors.

* * * * *